US006000391A

United States Patent [19]

Timmons

[11] Patent Number: 6,000,391

[45] Date of Patent: Dec. 14, 1999

[54] POSITIVE AIR FLOW VENTILATION SYSTEM

[76] Inventor: Henry D. Timmons, 1201 Smith Ave., P.O. Box 8, Crossfield, Alberta, Canada, T0M 0S0

[21] Appl. No.: 09/170,009

[22] Filed: Oct. 13, 1998

[51] Int. Cl.[6] ..... F23J 11/00

[52] U.S. Cl. ..... 126/307 R; 126/312; 126/80; 110/160

[58] Field of Search ..... 126/112, 307 R, 126/307 A, 312, 298, 85 B, 80, 77, 162, 160

[56] References Cited

U.S. PATENT DOCUMENTS

| | | | |
|---|---|---|---|
| 891,900 | 6/1908 | Belvin . | |
| 1,575,056 | 3/1926 | Johnson . | |
| 2,188,741 | 1/1940 | Roberts . | |
| 2,274,341 | 2/1942 | Mueller | 237/55 |
| 2,614,336 | 10/1952 | Macrow | 34/21 |
| 2,764,972 | 10/1956 | Ryder | 126/307 |
| 2,898,839 | 8/1959 | McKann | 98/48 |
| 3,175,552 | 3/1965 | Sutton | 110/162 |
| 3,368,474 | 2/1968 | Sklar | 98/115 |
| 3,453,369 | 7/1969 | Dock | 13/1 |
| 3,570,423 | 3/1971 | Hemminson | 126/307 R |
| 3,963,416 | 6/1976 | Hempel et al. | 126/120 |
| 4,010,728 | 3/1977 | Hempel et al. | 126/120 |
| 4,372,195 | 2/1983 | Dorius | 98/115 |
| 4,436,080 | 3/1984 | Evans | 126/139 |
| 4,768,444 | 9/1988 | DeWerth et al. | 126/307 R |
| 5,012,793 | 5/1991 | Guzorek | 126/85 |
| 5,076,254 | 12/1991 | Shimek et al. | 126/512 |
| 5,542,407 | 8/1996 | Hawkinson | 126/77 |

FOREIGN PATENT DOCUMENTS

| | | | |
|---|---|---|---|
| 133421 | 6/1929 | France | 126/312 |
| 2552858 | 4/1985 | France | 126/312 |

*Primary Examiner*—James C. Yeung
*Attorney, Agent, or Firm*—Thomas E. Malyszko

[57] ABSTRACT

A ventilation system for urging flue gases from an exhaust source through an exhaust conduit has an exhaust outlet for venting the gases and an exhaust inlet communicating with the exhaust source. A blower fan is provided for creating a positive air flow away from the exhaust inlet to urge the flue gases through the exhaust conduit and out of the exhaust outlet. A blower pipe channels air from the blower fan into the exhaust conduit past the exhaust inlet so as to create a venturi effect to draw exhaust from the exhaust inlet into the exhaust conduit. Duct work may be provided so that the blower fan draws fresh air from the ambient, namely from outside the structure housing the exhaust sources, rather than from inside the structure.

17 Claims, 3 Drawing Sheets

POSITIVE AIR FLOW VENTILATION SYSTEM

FIELD OF THF INVENTION

The present invention relates to ventilation systems in general, and in particular to a ventilation system for urging exhaust through a chimney or exhaust conduit in a residential, commercial or industrial structure.

BACKGROUND OF THE INVENTION

Residential, commercial and industrial structures typically house some sort of combustion sources, such as a furnace and hot water tank, to provide heat and hot water to the occupants. Such combustion sources require air for combustion, and a ventilation in system to vent the resulting gas fumes or exhaust out of the structure. The hot exhaust will usually rise up the exhaust outlet or chimney of the ventilation system and exit to atmosphere.

However, as is well known, a down-draft, or back-draft, in the exhaust outlet may impede or even reverse the travel of the exhaust through the ventilation system. A down-drafts might arise due to atmospheric conditions, or where a "negative" air pressure (i.e. an air pressure lower than that outside the structure) is created within the structure during operation of another combustion source having another exhaust outlet. The most common example of the latter is in residential settings during operation of a fireplace having its own chimney. A fire in a fireplace will typically consume large quantities of indoor air which, if a window is not opened, will often be replaced by fresh air drawn into the residence by a down-draft through the ventilation system servicing other combustion sources, such as the furnace and hot water tank. Should the furnace and/or the hot water tank begin operation during such down-draft, the resulting exhaust may not be sufficient to create a proper up-draft in chimney, and so may be forced to escape into the utility room or other areas of the structure through an air inlet near the bottom of the chimney, through the exhaust source itself, or by another route. Such escape may cause smoke damage to contents within the structure, and may create a dangerous and potentially lethal situation if the fumes are toxic, such as carbon monoxide poisoning.

Prior art systems employ hinged doors or flaps (i.e. dampers) at the air inlet which are urged closed in a down-draft, but dampers do not always seal correctly and have been ineffective.

What is therefore desired is a novel ventilation system which overcomes the limitations and disadvantages of existing systems. Preferably, it should provide for a venting means to induce a positive air flow up an exhaust conduit to prevent down-drafts during operation of exhaust sources and to urge exhaust through the ventilation system to the ambient. In particular, the venting means should include a device for creating a venturi effect to help draw the exhaust away from the exhaust sources and channel the exhaust along the ventilation system toward the ambient. Preferably, the venting means should be controlled to operate only when desired, namely during operation of the exhaust sources when fumes must be vented. The ventilation system should also provide the option of channeling fresh air from the ambient to the venting means and exhaust sources so as not to deplete air within the structure and avoid negative air pressure therewithin.

SUMMARY OF THE PRESENT INVENTION

In one aspect the invention provides a ventilation system for venting exhaust from an exhaust outlet of an exhaust conduit comprising at least one exhaust pipe member leading from an exhaust source, said at least one exhaust pipe member joining said exhaust conduit at an exhaust inlet, and a blower member for forcing air through said exhaust conduit to create a positive air flow therethrough and to urge said exhaust from said exhaust inlet to said exhaust outlet.

In another aspect the invention provides a ventilation system for urging flue gases from an exhaust source through an exhaust conduit having an exhaust outlet for venting said gases and an exhaust inlet communicating with said exhaust source, the improvement comprising a blower for creating a positive air flow away from said exhaust inlet to urge said flue gases through said exhaust conduit and out of said exhaust outlet.

BRIEF DESCRIPTION OF THE DRAWING FIGURES

Embodiments of the invention will now be described, by way of example only, with reference to the accompanying drawings, wherein.

LIST OF REFERENCE NUMERALS IN DRAWINGS

Figure 1:
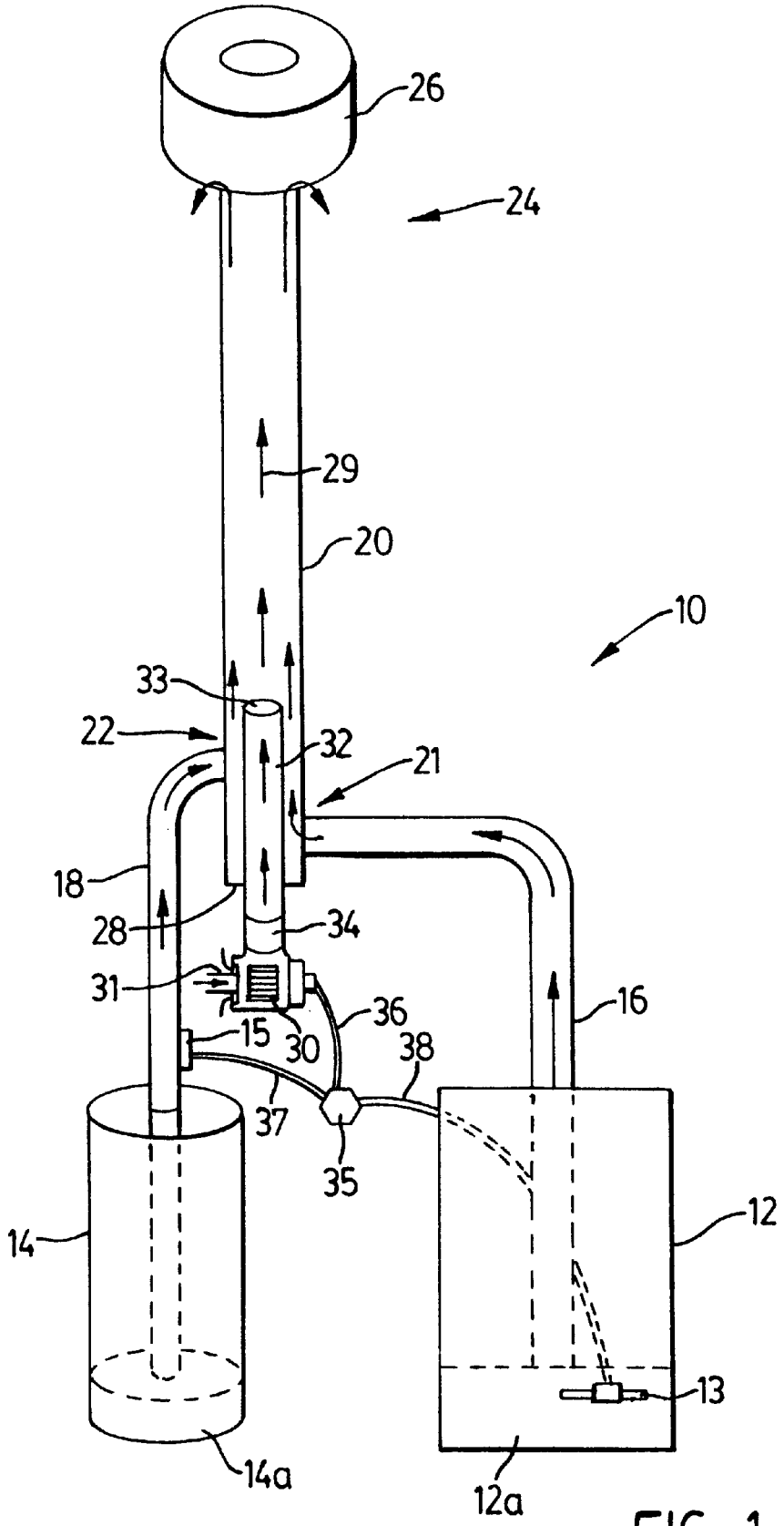
FIG. 1 is a schematic view of a ventilation system according to a first embodiment of the present invention wherein a gas fired furnace and hot water tank are exhaust sources and a blower blows draws air from inside a structure housing the furnace and tank and blows the air into an exhaust conduit.

10 ventilation system
12 furnace (exhaust source)
12*a* fire box of 12
13 gas valve at 12
14 hot water tank (exhaust source)
14*a* firebox of 14
15 thermal switch at 14
16 exhaust pipes for 12
18 exhaust pipes for 14
20 chimney (exhaust conduit)
21 chimney exhaust inlet for 16
22 chimney exhaust inlet for 18
24 exhaust outlet of 20
26 weather cap on 20
28 capped bottom end of 20
29 arrows indicating positive air flow in 20
30 blower
31 opening in 30
32 blower pipe
33 upper open end of 32
34 connector pipe
36 wiring for 30
37 wiring for 14
38 wiring for 12
40 fresh air duct
42 fresh air inlet for 40
44 boot/branch
46 first air passage to 30
48 second air passage to 12
50 third air passage to 14

52 air flow indicators
140 fresh air duct
142 fresh air inlet of 140

DESCRIPTION OF THE PREFERRED EMBODIMENTS

Referring first to FIG. 1, a ventilation system according to a first embodiment of the invention (generally designated by reference numeral 10) is located within a structure (not shown). A residential setting is chosen for illustrative purposes in which a natural gas fired furnace 12 and a natural gas fired hot water heater or tank 14 are exhaust sources in that during use the combustion of natural gas produces waste gas fumes or exhaust. It will be appreciated that the ventilation system of the present invention may also be used for other exhaust sources in commercial or industrial applications, and ones which use other fuels such as oil or coal.

The exhaust fumes from the exhaust sources 12, 14 typically travel through respective exhaust pipes 16 and 18 which connect to a generally vertically disposed exhaust conduit or chimney 20 at respective exhaust inlets 21 and 22. The exhaust entering the chimney 20 through the inlets 21, 22 is typically hotter than the ambient, and therefore travels up the chimney and exits the building to the ambient through a terminal exhaust exit port or outlet 24 as is well known. A weather cap or head 26 is placed about the exhaust outlet 24 to act as a wind and/or rain shroud. In residential applications a bottom end 28 is often located within the residence in a furnace or utility room which houses the furnace 12 and hot water tank 14. Prior art bottom ends 28 typically have an air inlet with a hinged damper which swings open when air is being sucked into the chimney 20, and which swings closed when a reverse air flow arises, namely a down-draft or back-draft. In the present embodiment the end 28 is capped to prevent air from entering the chimney, apart from the manner described below.

As noted earlier, a problem during such down-drafts is that the outward flow of exhaust in the exhaust pipes 16, 18 and in the chimney 20 is impeded or perhaps obstructed outright, which can result in potentially dangerous or lethal consequences if the toxic fumes are forced into the furnace room and elsewhere in the residence. An important aspect of the present invention, therefore, is the inclusion of an electrically operated blower fan 30 at the chimney's bottom end 28. The blower 30 is preferably, but not necessarily, mounted near an opening in the capped bottom end 28 so that it may blow fresh air (i.e. air from the furnace room and surrounding area) drawn through a blower air inlet 31 directly up into the chimney 20. With the blower operating, the forced air from the blower creates a positive air flow up the chimney, namely an air current away from the bottom end 28 and exhaust sources 12, 14 toward the exhaust outlet 24, as indicated by arrows 29.

Another important feature of the invention is a vertically disposed, open-ended, hollow, tubular blower pipe 32 mounted through the opening in the bottom end 28 of the chimney 20 which channels and directs the forced air from the blower into the chimney past the exhaust inlets 21, 22. The blower pipe's upper end 33 is located above both exhaust inlets 21, 22 so that the forced air from the blower does not enter the exhaust pipes 16, 18 and create a back-flow or down-draft into the fire boxes of the furnace 12 and tank 14. The blower pipe 32 may be either mounted directly at its lower end onto the blower, either connected or integrally, or via a short connector pipe 34. The blower pipe 32 should fit through the chimney's bottom end 28 (particularly if retrofitting is desired) and should not block the exhaust inlets 21, 22, namely the pipe 32 should be sized to carry a sufficient volume of air from the blower to create the desired positive air flow up the chimney and to avoid impeding egress of exhaust from the exhaust inlets 21, 22. Good results have been had with a cylindrically shaped blower pipe 33 centrally located within the chimney. The blower pipe may be shifted toward one side (i.e. off-center) if a significantly greater exhaust flow volume is expected from one exhaust outlet than another.

A further feature of the blower pipe 32 is that the air exiting the pipe's upper end 33 creates a venturi effect above the exhaust inlets 21, 22 so that the exiting air flow draws or helps "suck" the exhaust from the exhaust pipes 16 and 18, and urges the exhaust up the chimney. Hence, the exhaust is urged away from the bottom end 28 and from entering the structure housing the exhaust sources.

The blower 30 is wired to a control box 35 via wiring 36. Likewise, a thermal switch 15 on the hot water tank 14 is linked to the control box by wiring 37, and a furnace gas valve 13 is linked to the control box with wiring 38 as well as to a thermostat for controlling the furnace's operation. The control box may therefore control operation of the blower 30 based on input from the tank, the furnace or other criteria. Typically, the blower will be activated upon activation of a heating cycle for the tank 14 or furnace 12 which results in a flow of exhaust gases from respective fire boxes 14*a*, 12*a* through the exhaust pipes 16, 18.

Figure 2:
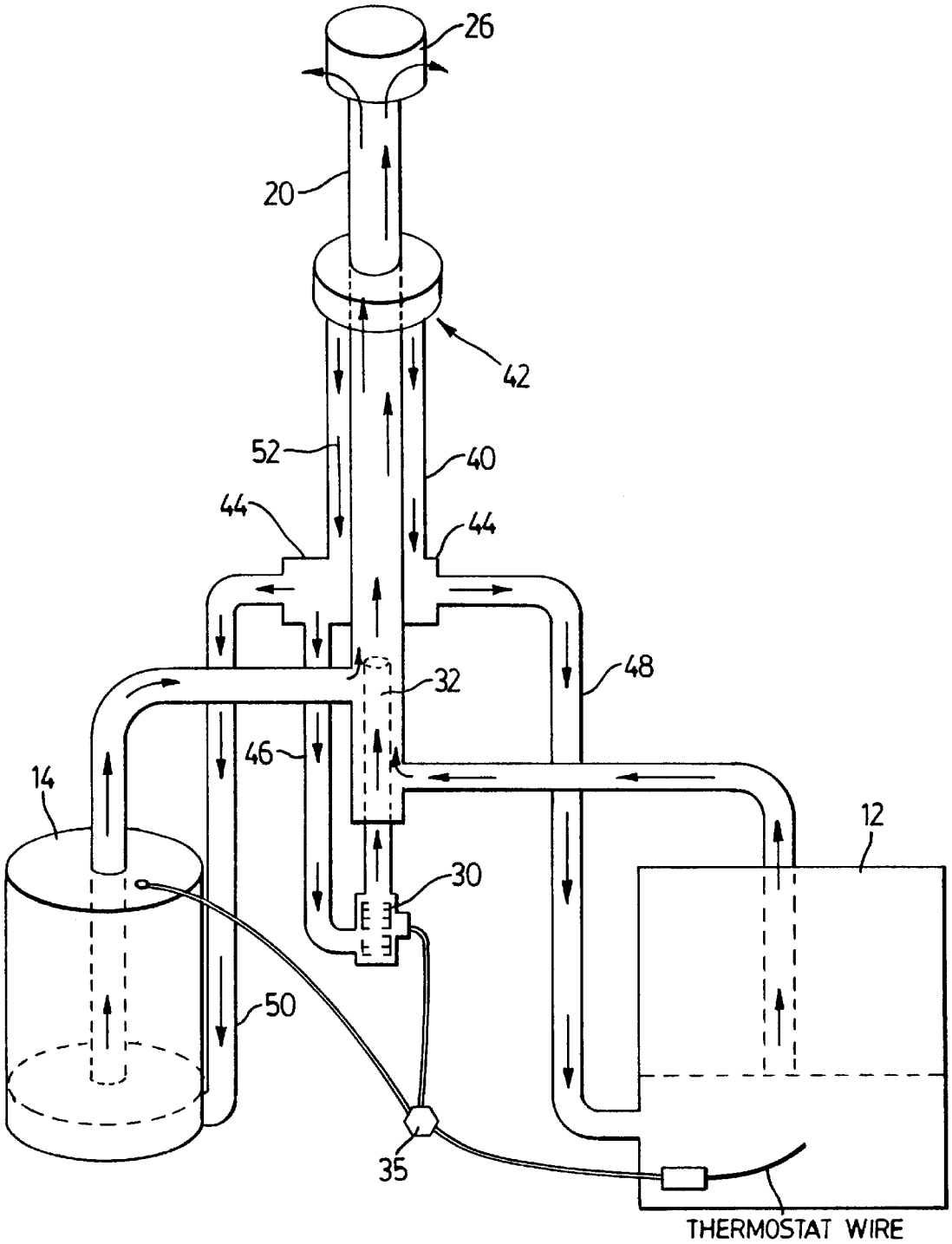
FIG. 2 shows a second embodiment of the present invention in which air is drawn from outside the structure, passes beside the exhaust conduit, and is channeled to the furnace and tank as well as into the exhaust conduit.

In a second embodiment of the present invention shown in FIG. 2, duct work is provided so that the blower 30 draws fresh air from the ambient, namely from outside the structure housing the furnace 12 and hot water tank 14, rather than from inside the structure. For each of the various embodiments disclosed herein, the same reference numerals are used for the same or substantially similar components. A fresh air duct 40 envelopes the chimney 20 and extends high enough along the chimney so that a fresh air inlet 42 is above the building's roof and is able to communicate with the ambient. The duct 40 extends downwardly and splits or branches out at a boot 44 from where a first fresh air passage 46 continues to the blower 30 which draws fresh air therefrom. Likewise, second and third fresh air passages 48 and 50 extend from the boot 44 to the furnace 12 and the hot water tank 14, respectively, to provide fresh air for combustion. Hence, it will now be appreciated that the blower 30, when activated, not only forces air into the chimney 20, but draws fresh air (indicated by the arrows 52) from the ambient via duct 40 and passages 46, 48 and 50 for combustion and to create a positive air flow in the chimney, without depleting or using air from within the structure. Hence, a negative air pressure is not created in the structure when the combustion sources, namely the furnace and hot water tank in this case, are operating.

Figure 3:
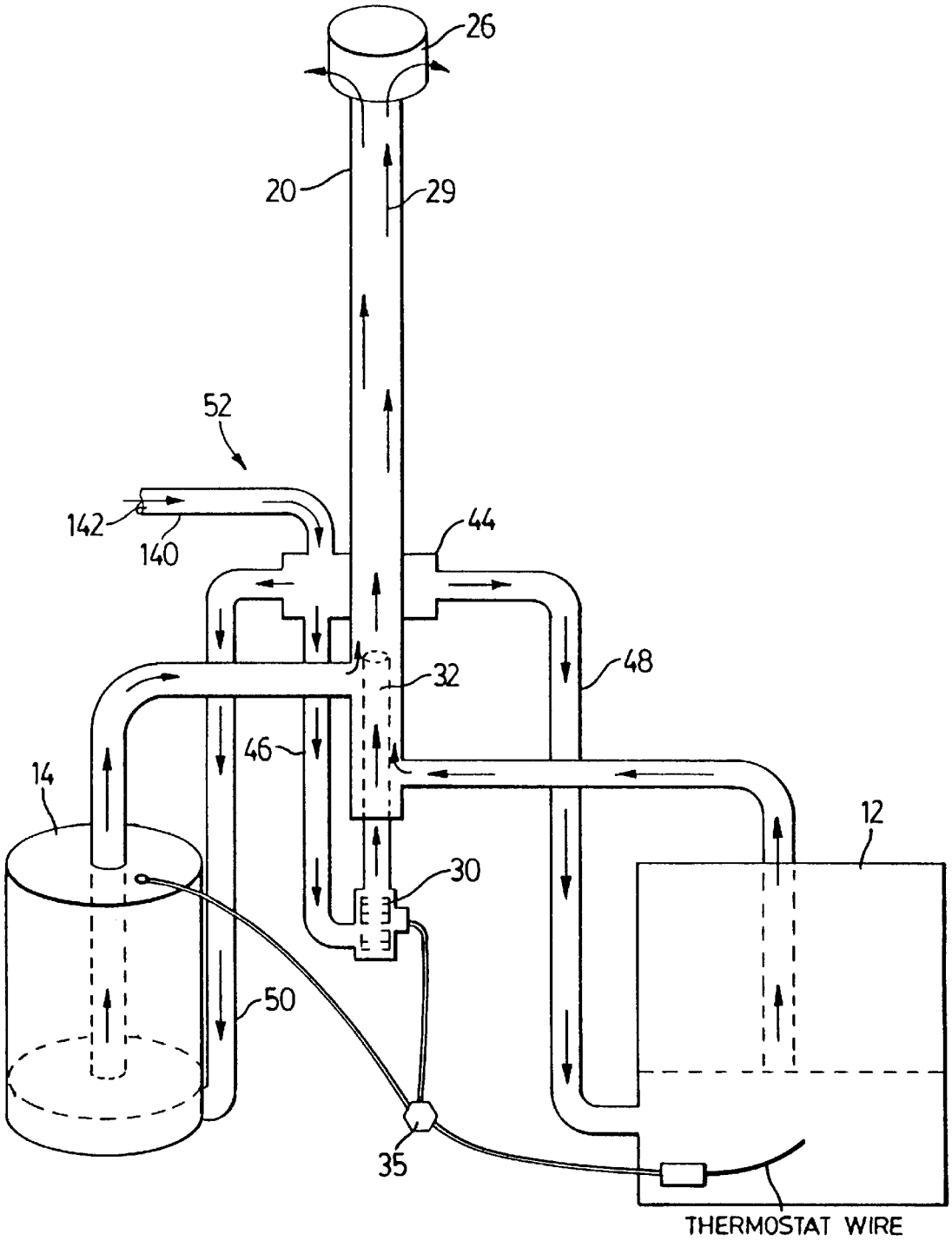
FIG. 3 shows a third embodiment of the invention in which air drawn from outside the structure passes along a route other than the one in FIG. 2.

In a third embodiment of the invention shown in FIG. 3, the fresh air duct 140 does not extend along the chimney as in the FIG. 2 embodiment, but is routed elsewhere, such as between floor joists, through the structure until the fresh air inlet 142 communicates with the ambient outside the structure or at some other suitable fresh air source. The duct 142 communicates with the boot 44 in a manner similar to that in FIG. 2, and so fresh air is distributed to the blower and combustion sources as described earlier.

The operation and many advantages of the present invention may now be better understood. First, wiring the blower 30, furnace 12 and hot water tank 14 to a control box allows a user to regulate operation of the blower when required, namely so that the A blower runs only during operation of the fire boxes in either the furnace or the hot water tank. Hence, the blower need not run all the time. It is noted that should the blower malfunction and not operate when necessary, air may still enter into the chimney through the exhaust inlets 21 and 22.

Second, in operation, the blower 30 forces air up the chimney and creates a positive air flow toward the exhaust port 24 so that any exhaust within the chimney is urged out of the chimney to atmosphere. Hence, the invention eliminates down-drafts in the chimney during operation of the exhaust sources, and so avoids potentially lethal situations in which toxic fumes are carried by such down-drafts into the structure housing the exhaust sources.

Third, the air exiting the blower pipe's upper end creates a venturi effect which draws the exhaust from the exhaust pipes 16 and 18, and therefore urges the exhaust fumes up the chimney to avoid having toxic fumes entering the structure housing the exhaust sources.

Fourth, the second and third versions of the invention further isolate the ventilation system from the inside of the structure by channeling fresh air from the ambient to the blower and to the exhaust sources. Hence, air from inside the structure is not required nor drawn for operation of the furnace and hot water tank, nor for the positive air flow created by the blower. This is particularly advantageous where the structure has another chimney and combustion device, such as a residential fireplace. A problem with fireplaces in that a back-draft can be created down the chimney 20 due to the fireplace drawing air from within the residence. The present invention avoids such problems by providing air from outside the structure to the ventilation system 10 and forcing it up the chimney.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For example, the blower 30 may be located along the chimney 20 above the highest exhaust inlet 21 or 22 so as to draw air through the blower pipe 32 into the chimney. Such a version, however, is not preferred since it is more difficult to mount, and so may be more expensive to install.

I claim:

1. A ventilation system for venting exhaust from a plurality of exhaust sources housed within a structure comprising:

an elongate exhaust conduit having an exhaust outlet at an upper portion open to atmosphere and a plurality of exhaust inlets at an opposed lower portion thereof within said structure, each exhaust inlet communicating with a respective exhaust source;

a blower member housed within said structure and communicating with said lower portion of the exhaust conduit for forcing non-combusted air through said exhaust conduit for creating a positive air flow therethrough to urge said exhaust from said exhaust inlets to said exhaust outlet;and means for controlling operation of said blower member in concert with the operation of any one of said exhaust sources.

2. The ventilation system of claim 1 further including a blower pipe element for air communication between said blower member and said exhaust conduit, said blower pipe element discharging said air from said blower member into said exhaust conduit downstream of said plurality of exhaust inlets to create said positive air flow.

3. The ventilation system of claim 2 wherein said blower pipe element has an open terminal end opposite said blower member terminating immediately downstream of the exhaust inlet closest to said exhaust outlet, said blower pipe element being located in said exhaust conduit so as to create a venturi effect about said terminal end to draw said exhaust from said plurality of exhaust sources into said exhaust conduit.

4. The ventilation system of claim 3 wherein said blower member is located proximate said lower portion of the exhaust conduit, and said blower pipe element enters said exhaust conduit at said lower portion thereof.

5. The ventilation system of claim 2 wherein said blower member is located proximate said lower portion of the exhaust conduit, and said blower pipe element enters said exhaust conduit at said lower portion thereof.

6. The ventilation system of claim 2 wherein said blower member draws said air from an area within a structure which houses said plurality of exhaust sources.

7. The ventilation system of claim 2 wherein said blower member draws said air from a fresh air duct member communicating with the ambient.

8. The ventilation system of claim 1 wherein said blower member draws said air from an area within a structure which houses said plurality of exhaust sources.

9. The ventilation system of claim 1 wherein said blower member draws said air from a fresh air duct member communicating with the aimbient.

10. The ventilation system of claim 9 wherein said fresh air duct member extends adjacent a portion of said exhaust conduit.

11. The ventilation system of claim 10 wherein said fresh air duct member includes a first passage for bringing said air to said blower member, and at least one second passage for bringing air from the ambient to at least one of said plurality of exhaust sources for combustion.

12. The ventilation system of claim 9 wherein said fresh air duct member includes a first passage for bringing said air to said blower member, and at least one second passage for bringing air from the ambient to at least one of said plurality of exhaust sources for combustion.

13. In a ventilation system for urging flue gases from at least two exhaust sources housed within a structure through an elongate exhaust conduit having an exhaust outlet at a first end thereof for venting said gases and a plurality of exhaust inlets at an opposed second end within said structure, each exhaust inlet communicating with a respective one of said exhaust sources, the improvement comprising:

a blower housed within said structure communicating with said second end of the exhaust conduit, but not with any of said exhaust sources, for drawing fresh air into said exhaust conduit for creating a positive air flow away from said exhaust inlets to urge said flue gases through said exhaust conduit and out of said exhaust outlet, and means for activating said blower in concert with the operation of said exhaust sources.

14. The ventilation system of claim 13 further including an elongate blower conduit leading from said blower into said exhaust conduit and past said exhaust inlets for directing said air from said blower into said exhaust conduit to create said positive air flow therethrough.

15. The ventilation system of claim 14 wherein an open terminal end of said blower conduit terminates immediately above the exhaust inlet closest to said exhaust outlet and said blower conduit being placed in said exhaust conduit so as to create a venturi effect immediately above said closest exhaust inlet to draw said flue gases from said plurality of exhaust inlets into said exhaust conduit.

16. The ventilation system of claim 15 wherein said blower is located immediately below said second end of the exhaust conduit, and said blower conduit enters said exhaust conduit at the second end thereof.

17. The ventilation system of claim 14 wherein said blower is located adjacent said second end of the exhaust conduit, and said blower conduit enters said exhaust conduit at the second end thereof.

* * * * *